United States Patent [19]

Hyde et al.

[11] 4,039,424

[45] Aug. 2, 1977

[54] PROCESS FOR PRODUCING FLUID FUEL FROM COAL

[75] Inventors: Richard W. Hyde, Winchester; Stephen A. Reber, Waltham; August H. Schutte, Lexington; Ravindra M. Nadkarni, Arlington, all of Mass.

[73] Assignee: Arthur D. Little, Inc., Cambridge, Mass.

[21] Appl. No.: 671,174

[22] Filed: Mar. 29, 1976

[51] Int. Cl.[2] ..... C10G 1/06

[52] U.S. Cl. ..... 208/8; 208/50

[58] Field of Search ..... 208/8, 50

[56] References Cited

U.S. PATENT DOCUMENTS

| | | | |
|---|---|---|---|
| 2,221,410 | 11/1940 | Pier | 208/8 |
| 2,686,152 | 8/1954 | Franke | 208/8 |
| 3,018,242 | 1/1962 | Gorin | 208/8 |
| 3,117,921 | 1/1964 | Gorin | 208/50 |
| 3,503,864 | 3/1970 | Nelson | 208/8 |
| 3,518,182 | 6/1970 | Paterson | 208/50 |
| 3,733,183 | 5/1973 | Singh | 208/8 |

*Primary Examiner*—Delbert E. Gantz
*Assistant Examiner*—James W. Hellwege
*Attorney, Agent, or Firm*—Bessie A. Lepper

[57] ABSTRACT

Process for producing fluid fuel from coal. Moisture-free coal in particulate form is slurried with a hydrogen-donor solvent and the heated slurry is charged into a drum wherein the pressure is so regulated as to maintain a portion of the solvent in liquid form. During extraction of the hydrocarbons from the coal, additional solvent is added to agitate the drum mass and keep it up to temperature. Subsequently, the pressure is released to vaporize the solvent and at least a portion of the hydrocarbons extracted. The temperature of the mass in the drum is then raised under conditions required to crack the hydrocarbons in the drum and to produce, after subsequent stripping, a solid coke residue. The hydrocarbon products are removed and fractionated into several cuts, one of which is hydrotreated to form the required hydrogen-donor solvent while other fractions can be hydrotreated or hydrocracked to produce a synthetic crude product. The heaviest fraction can be used to produce ash-free coke especially adapted for hydrogen manufacture. The process can be made self-sufficient in hydrogen and furnishes as a by-product a solid carbonaceous material with a useful heating value.

34 Claims, 3 Drawing Figures

PROCESS FOR PRODUCING FLUID FUEL FROM COAL

Figure 1:
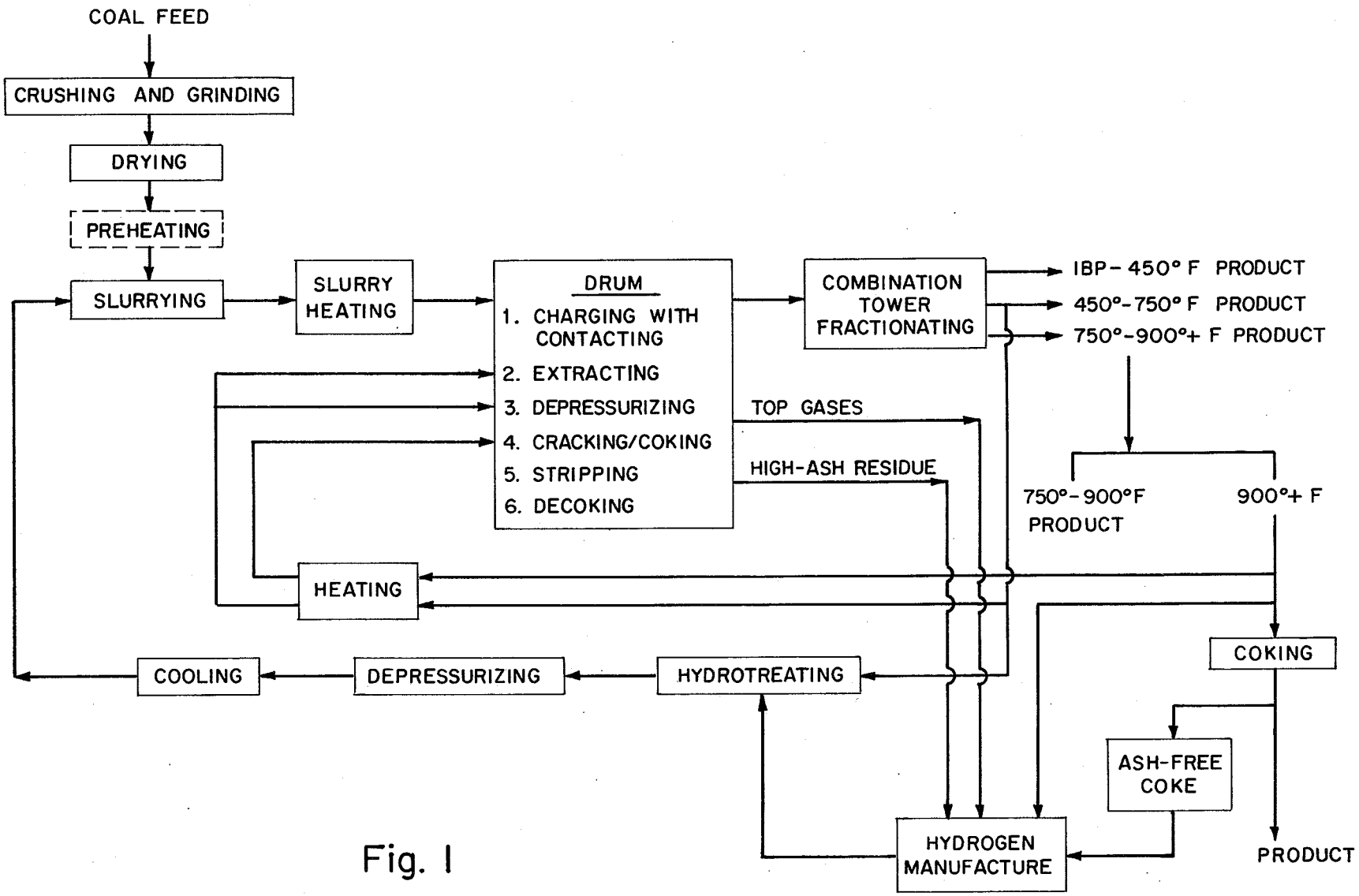

This invention relates to the conversion of coal to liquid fuel and more particularly to a process for the production of fluid (gas and liquid) hydrocarbon fuels from coal.

The possibilities of gasifying and of liquefying coal to obtain hydrocarbon fuels have been recognized for some time; but up until recently the economic impetus to provide efficient and profitable processes for carrying out the techniques developed has been lacking. Now, however, with the realization that known vast coal deposits must be looked to for meeting a much larger proportion of our energy requirements in the future, the need for improved processes for converting coal into some forms of liquid fuels becomes of paramount interest.

The process of this invention is concerned with the conversion of coal to liquid hydrocarbon fuels in contrast to its conversion to a substitute natural gas. There are several important advantages to the liquefaction of coal as compared to gasification. Among such advantages are the requirement for less hydrogen, the use of less drastic physical conditions, the greater ease of storing and transporting, and the ability to use the resulting liquid fuels as feedstock for chemical processes.

The liquefaction of coal may give rise to several different types of products which are generally classified as deashed coal, low-sulfur heavy fuel oil, synthetic crude oil, and premium white fuels. The first two of these types presents as yet unsolved problems in production and handling and they are therefore not considered, although they can be made by the process of this invention if they ever become standard commercial products. For some purposes, synthetic crude oil is the optimum product; while in others the premium white fuels are desired. Since, however, the synthetic crudes can be converted to white fuels by refinery-type hydroprocessing and treating, both of these two types of products resulting from the liquefaction of coal are made available through the practice of this invention.

There have been several prior art approaches to the liquefaction of coal. The first of these may be termed the Fischer-Tropsch method and it involves the gasification of coal to produce a gas, containing hydrogen and carbon monoxide, that is subsequently reacted over a catalyst to produce liquid fuels such as hydrocarbons or methanol. In a second prior art process for liquefying coal, termed pyrolysis, the coal is heated in an inert atmosphere to drive off volatiles from which oils are condensed. The remaining prior art processes rely on addition of hydrogen to coal to produce liquids. Fuels for the German military in World War II were made from coal by high pressure (5000 to 10,000 psi) hydrogenation in slurry form with a catalyst. Two presently known processes involve improvements over the German technology. In one of these, the coal is treated with a recycled coal oil; solids are removed by filtration or centrifugation; and the resulting ash-free liquid is then hydrogenated if desired. This process referred to as the Pamco process typically produces a deashed product that is solid at room temperature. In the other coal liquefaction process, which has probably received the most attention of all of these processes, a slurry of coal and recycled oil is reacted with hydrogen under pressure (e.g., 2000–3000 psi ) in the presence of a catalyst in an ebullated bed. When solids are removed, the liquid product can be further treated by reaction with hydrogen. The last of these processes is referred to as the "H-coal" process and has been widely described in the literature.

Those processes which begin with gasification have several important inherent disadvantages, among which are high hydrogen requirements and therefore high cost, relatively low yield, low thermal efficiency and need for relatively drastic physical conditions. The last two processes based upon solvation require very high pressures and present serious problems in catalyst separation, heat exchange with slurries and in solid-liquid separation at high temperatures and pressures.

From this brief discussion of the prior art it will be seen that it would be desirable to have a process available for the liquefaction of coal which eliminated or at least to some extent minimized the disadvantages associated with prior art processes.

It is therefore a primary object of this invention to provide an improved process for making synthetic crude oil from coal, the process being based upon the liquefaction of coal through solvation. A further primary object is to provide such a process which produces fluid hydrocarbon fuels from coal which, during production, are cracked to a lower boiling range and upgraded in that the hydrogen to carbon ratio is increased; which produces these fuels in a form which makes them more suitable for subsequent hydrocracking and desulfurization; and which also produces inert solid carbonaceous material with a low but useful heating value. It is another object of this invention to provide a process of the character described which is efficient and requires less drastic operating conditions than heretofore used in the liquefaction of coal.

Still another object is to provide a coal liquefaction process which is based upon the use of a recycled solvent and which eliminates the need for handling high-pressure slurries and the necessity for the letdown of these slurries through pressure-reducing valves. Yet another object of this invention is the providing of a coal liquefaction process which eliminates mechanical separation procedures including the filtration of ash and residue solids from liquids. It is an additional object to provide a coal liquefaction process which is sufficiently flexible in operation to vary the characteristics of the products which include synthetic crude oils which will produce premium white fuels when charged to a conventional oil refinery. An additional object is to provide such a process which requires less hydrogen than prior art processes to produce light products and which is essentially self-sufficient in fuel as well as in the hydrogen required to produce the desired liquid fuel product line.

In brief, the process of this invention comprises the steps of forming a slurry of finely divided, moisture-free coal and a hydrogen-donor solvent; heating the slurry to an elevated temperature up to about 850° F; charging the heated slurry into a drum wherein the coal is further contacted with the hydrogen-donor solvent; maintaining the pressure within the drum at a level such that a portion of the hydrogen-donor solvent remains liquid while extracting hydrocarbons from the coal; during the extracting, adding hydrocarbon solvent vapor at an elevated temperature up to about 900° F thereby to agitate the mass within the drum and to further heat it; depressurizing the drum to flash off the hydrocarbons while providing the latent heat of vaporization required for the volatilization of the hydrocarbons; withdrawing the fluid hydrocarbons from the drum; fractionating the fluid hydrocarbons withdrawn from the drum to form at least three cuts comprising a light cut hydrocarbon product, a medium cut hydrocarbon product having a boiling range of 450° F to 750° F and a heavy cut hydrocarbon product; adding to the drum a hydrocarbon fraction at a temperature sufficient to heat the contents of the drum to about 850° F to 900° F in a quantity, for a time and at a pressure sufficient to crack at least a portion of the hydrocarbon fractions extracted from the coal and remaining in the drum and to coke the residual solids in the drum thereby to produce additional fluid hydrocarbon product; removing the additional fluid hydrocarbon product from the drum and adding it to the fluid hydrocarbon withdrawn; and decoking the drum to remove the coked residue therefrom.

The invention accordingly comprises the several steps and the relation of one or more of such steps with respect to each of the others thereof, which will be exemplified in the following detailed disclosure, and the scope of the invention will be indicated in the claims.

Figure 2:
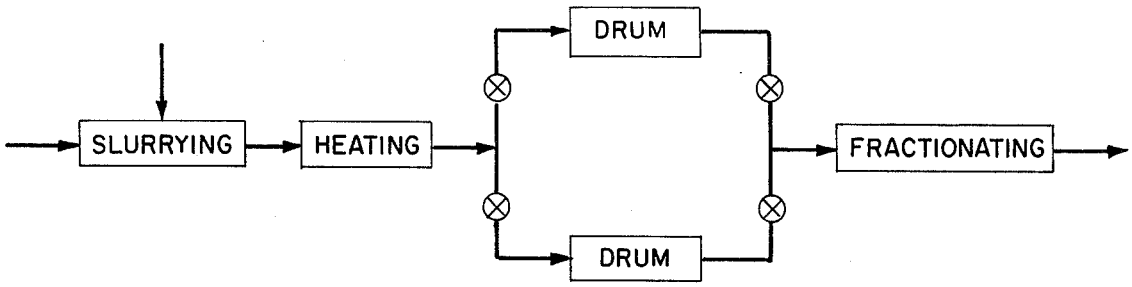
Figure 3:
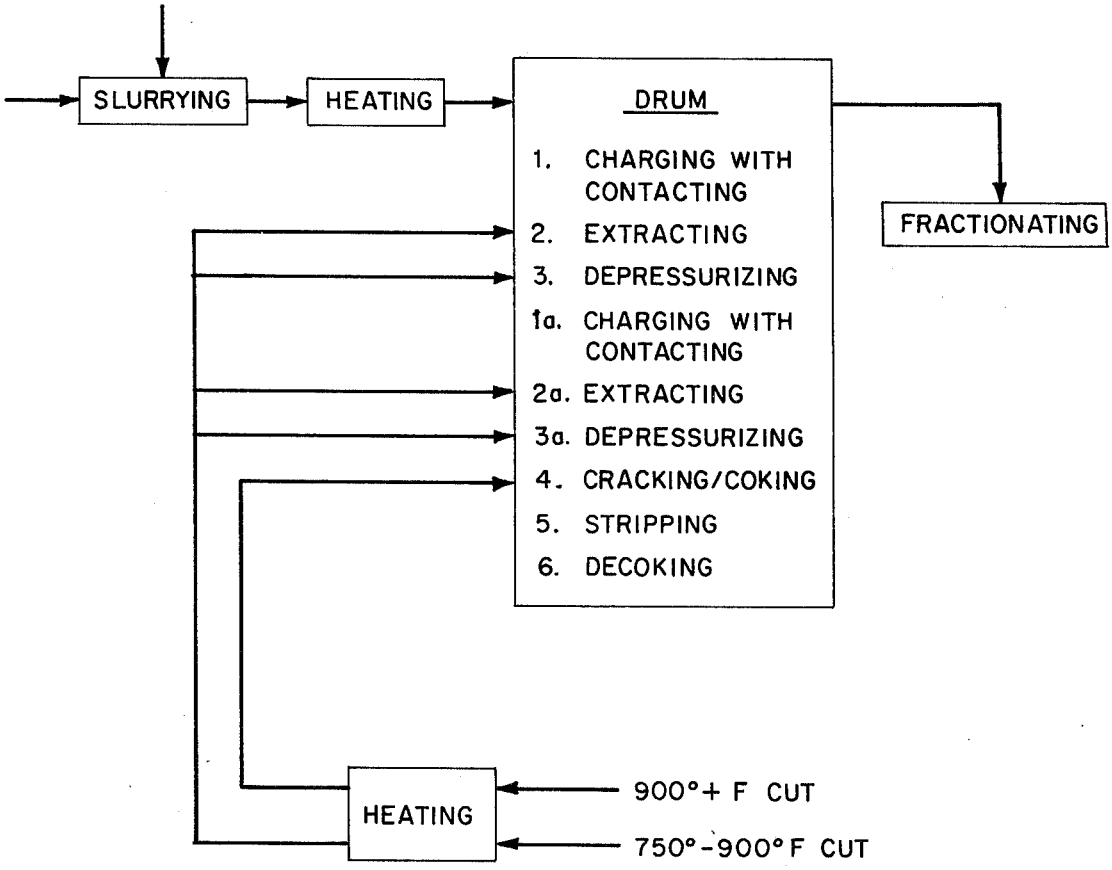

For a fuller understanding of the nature and objects of the invention, reference should be had to the following detailed description taken in connection with the accompanying drawings in which FIG. 1 is a flow diagram detailing the steps of the process of this invention;

FIG. 2 illustrates a modification of the process showing the use of multiple drums; and FIG. 3 illustrates a modification of the process in which the combination of steps of charging, contacting, extracting and depressurizing is repeated at least once in the drum prior to the cracking/coking step.

The steps of extraction, cracking and coking, along with such subsequent steps as final liquid recovery and decoking, are preferably carried out in a drum such as is used for delayed coking. A combination tower for fractionation of the liquid hydrocarbons produced is associated with one or more drums.

As will be apparent from the following discussion, the total extraction is performed in several steps, the conditions for which may be varied within certain limits. These steps may be termed charging with contacting, extracting using heating and pressurization, depressurizing, cracking/coking, stripping and finally decoking to remove the solid residue to place the drum in condition for the repetition of these steps. The overall extraction phase of this process is therefore, of necessity, a batch operation. However, as will be described below, several drums may be used in series with the fractionating equipment operating continuously to make it possible to obtain an essentially continuous operation. Moreover, it is possible to process several batches in the drum up to the cracking/coking step before the final steps are performed.

The process of this invention is diagrammed in FIG. 1. The coal is crushed and ground to a fine particulate feed, that is preferably to reduce it to a particle size so that about 80 percent is minus-200-mesh. Although particle size does not appear limiting in the extraction for sizes up to 8-mesh, the finely sized coal is easier to pump in a slurry. Moreover, the contacting of solvent and coal in the drum is more effective for the finer sized material. The finely divided coal is then thermally dried to remove moisture by any suitable, well-known technique. The dried coal will normally be at a temperature of about 100° F. As an optional step, the dried coal may be preheated up to about 400° F prior to slurry formation.

The coal is introduced into the drum in the form of a solvent/coal slurry, the solvent being one which is capable of extracting the hydrocarbons from the coal. Solvents suitable for the extracting step are those which are known as hydrogen-donor solvents, i.e., they are able to release hydrogen to the coal. These solvents may generally be defined as a middle cut with a boiling range between about 400° and 900° F. For example phenanthrene, tetralin and naphthalene are suitable solvents. The higher boiling range solvents give deeper extraction penetration but they require greater effort in separation. The solvent for this process preferably results from moderate but controlled hydrotreatment of a selected boiling range (e.g., 450° F to 750° F) cut of the coal-derived liquids. The derivation and subsequent hydrotreating of this product cut will be described below.

The coal/solvent slurry may be formed under one of several alternative conditions. The coal will in all cases be at a temperature ranging between about 100° F and 400° F. The solvent at the time of slurry formation may all be "cold", i.e., at least 100° F and no greater than about 200° F. The solvent may all be "hot", i.e., above 200° F and up to 600° F; or a combination of hot and cold solvent may be used. However the slurry is formed, its final temperature during formation must be below that at which the viscosity peak is reached at about 550° F. If the slurry is formed in a closed system in which some pressure buildup is possible, then the slurrying step may take place at a temperature above the boiling point of the solvent. If, however, it is formed in an open system, the temperature of the slurry should be below the boiling point of the solvent.

Typically, for an open system if the coal at the point of slurrying is about 100° F, the solvent temperature will range between about 500° and 600° F. The weight ratio of liquid solvent to solid coal may range between about one to one and about four to one, with a preferred range being from about 1.5 to one to about three to one.

Subsequent to the formation of the slurry it is heated to the desired extraction temperature (between about 700° F and 850° F) and pumped into the drum. The heating of the slurry is preferably done in a direct-fired heater. In one embodiment of the process, the drum during charging is maintained at a pressure level at which a substantial portion of the solvent is in the liquid state. Generally, this maximum drum pressure will range between about 50 psig and about 150 psig. For example, the pressure required in the drum for a hydrotreated coal-derived solvent having a boiling range between about 475° F and 750° F will be at least about 65 psig. It may be necessary to preheat the drum prior to charging it with the slurry. However, when several drums are used in parallel and are alternately connected to the heated slurry line, the residual heat in the drum may be sufficient to make any preheating unnecessary. It may be necessary to pressurize the drum, at least prior to charging it with the heated slurry. Pressurizing may also be desirable during charging. This pressurizing is preferably done with a hydrocarbon gas, although a noncondensible gas such as nitrogen can be used. During all of those steps which are carried out in the drum, the pressure within the drum is readily controlled by proper manipulation of a pressure-control valve on the drum.

In another embodiment of the process of this invention, the drum pressure is maintained between about 20 psig and about 80 psig in order to continuously flash off from about 10% to about 70% of the solvent comprising primarily the lighter cuts of the solvent.

Charging of the drum with the heated slurry is continued until the desired amount of solvent and coal is introduced. During this charging step the required contacting of the coal by the solvent is accomplished and some extracting of hydrocarbons from the coal takes place. During contacting, a portion of the solvent liquid, along with coal-derived hydrocarbons, is continuously being vaporized and sent to the combination tower for fractionation. During charging and contacting the mass within the drum is brought up to a temperature between about 650° F and about 800° F. Typically this charging with contacting and partial extracting may take about 2 to 8 hours. However, this timing is not critical since the sequence of steps which are performed subsequently leaves flexibility in the time of this combination of steps. In some instances it may be desirable to hold the solvent and coal under charging/contacting temperature and pressure conditions in the drum for a period, e.g., an hour or so, after charging is complete. However, this is optional.

When charging has been completed (with or without any additional contacting holding period) extraction is completed by thoroughly agitating the mass within the drum. This is done by introducing a portion of the unhydrotreated middle fraction of the coal-derived product having a boiling range between about 450° F and about 750° F. This coal-derived solvent is heated in a suitable device, such as in a direct-fired heater, to between about 750° F and about 900° F and is caused to flow through the drum as a vapor while maintaining a pressure of from about 50 psig to 150 psig. This additional flow of solvent vapor serves to agitate the mass within the drum while maintaining its temperature between about 750° F and 800° F without substantial loss of solvent through vaporization. During extraction, a substantial portion of the soluble hydrocarbon fractions of the coal is extracted to become part of the fluid contained within the drum. It is also possible during the extraction period to gradually reduce the pressure in the drum to boil off some of the solvent and thus further agitate the mass in the drum to aid in the extraction.

Extraction time is that required to complete a predetermined degree of extraction. The actual extraction time will, in turn, depend upon the solvent used, the degree of extraction desired, the temperature and pressure ranges and the coal particle size. Since it is preferable to extract at least about 80% to 90% by weight of all of the extractables in the coal, the attainment of this goal will largely determine the time period required for the combined steps of charging/contacting and extracting. Thus optimum time for this step may readily be determined for any particular combination of coal feed type and solvent used, along with the temperature and pressure ranges employed. In general, a relatively short time, e.g. not more than about an hour, after charging the coal into the drum should be sufficient to complete extraction.

Upon completion of the extraction of the hydrocarbon fractions from the coal, the drum is depressurized to between about 50 psig and atmospheric pressure (0 psig). As a result of this depressurization, gases and the light hydrocarbons are discharged from the drum to the combination tower for fractionating into various cuts as described below. During this depressurizing, it is preferable to continue to introduce solvent vapors in the form of the unhydrogenated refractory cut having a boiling range between about 450° F and 750° F. Since the primary purpose of the introduction of solvent vapors during this depressurizing step is to provide the latent heat of vaporization for the flashing off of the solvent and product hydrocarbons, the solvent vapors are heated to between about 750° F and 950° F prior to being directed into the drum. Thus the mass within the drum remains at essentially constant temperature. The depressurization and flashing off of vapors requires between about 2 and 4 hours. The amount of unhydrotreated medium cut solvent added in this step is that which is required to provide the necessary heat input for the entire period of depressurizing.

In the basic process diagrammed in FIG. 1, a single drum is shown for illustrative purposes as being used with the slurrying and slurry heating equipment. In large-scale installations, it will however be more practical to maintain an essentially continuous slurrying and slurry heating operation going. This can be accomplished by using two or more drums in parallel as shown in FIG. 2. The final selection of the timing of the various steps within the drums will, of course, determine the number used and this choice is well within the capability of one skilled in the art. Moreover, the use of the multiple drums will make it possible to maintain a steady state operation in the combination tower, or similarly suitable apparatus, for carrying out the fractionating step.

Another modification of the process of this invention is shown in FIG. 3. Because the mass remaining in the drum after depressurizing fills only a portion of the drum volume, and since the steps of cracking, coking, stripping and decoking require a major portion of the time required in one cycle of the process, it may be feasible to repeat the steps of charging, contacting extracting and depressurizing at least once before proceeding with these last steps. It will also be apparent that the cycle of FIG. 3 contributes an added degree of flexibility to the operation of the process when using multiple drums in series as shown in FIG. 2.

Returning to FIG. 1, the remaining steps of the basic process may be detailed. The next step to be carried out in the drum is that of a combination of cracking the high-boiling liquids and coking the solid residue. This combined cracking/coking step is carried out by heating the drum contents up to at least 850° F to 900° F. This is accomplished by introducing one or more cuts from the fractionator into the drum to transfer heat into the mass contained within the reactor drum. Preferably this liquid is partially, if not wholly, made up of an additional quantity of the middle cut (b. p. 450° F–750° F) which is heated to the required 850° F to 900° F. The liquid introduced into the drum for cracking/coking may also contain some of the bottom heavy fraction from the combination tower used in he fractionation of the coal-derived product hydrocarbons. Like the liquid used in the contacting/extracting and stripping steps, this solvent is preferably heated in a direct-fired heater.

In this cracking/coking step the pressure within the drum may range from about 15 psig to about 70 psig. If the quality of the product hydrocarbons is to be maximized, then the use of higher pressures lowers their boiling range but increases the amount of coke formed. If, however, it is desirable to maximize the yields of the product hydrocarbons rather than their quality, then cracking/coking may be carried out at the lower pressures.

The amount of high-temperature solvent introduced into the drum to achieve cracking/coking is determined by the heat requirements of the drum's contents and it may be readily calculated. The liquid inventory in the drum will gradually diminish during this phase, being controlled by the drum temperature and pressure, and the amount of gas and light cuts entering into the combination tower.

At the end of the cracking/coking step the drum contains the coal residue solids plus the coke formed from the extract plus a small amount (e.g., 10 to 15 weight percent of the coal) of heavy residual oil. The drum outlet is then disconnected from the combination tower and opened to a steam-out pot. Steam may then be introduced to obtain an oil partial pressure of the order of about 5 psia (equivalent to 12 pounds of steam per pound of oil). The drum temperature will drop from about 850° F–900° F to about 750° F–800° F due to oil vaporization. The steam stripping results in the removal of additional oil and reduces the volatile matter in the coke to an acceptable level, e.g., about 9 to 12 weight percent.

The final step to be carried out in the drum, subsequent to steam stripping is that of decoking, which comprises introducing a high-pressure water jet (for example under about 2000 pounds pressure) to cut and flush out the coke from the drum.

During the steps of charging with contacting, extracting, depressurizing and cracking/coking, the vapors from the drum are subjected to fractionation in the combination tower such as now employed, for example, in a delayed coking process. Since the product from the extraction is all in the form of vapors and is free of solids, including ash and unreacted carbon, no costly, difficult and time-consuming separation step such as mechanical separation of liquids and solids of a slurry, is required. In this fractionation, the vapors from the drum may be separated into three or more cuts. Thus in FIG. 1 the overhead cut is shown to comprise a light distillate extract ($C_1$ to 450° F boiling range), the side or medium cut is a recycle solvent having a boiling range between about 475° F and 750° F; and the third is a heavy cut with the heavy bottoms having a boiling range in excess of 750° F. This last cut may be divided further into a heavy side cut (b.p. range 750° F to 900° F) and a 900° F+ heavy extract fraction.

The light overhead cut can be depropanized and then blended into the synthetic crude product. Alternatively, it can be treated and used as a gasoline base stock.

A minor portion of the medium cut from the fractionation tower is withdrawn and blended into the synthetic crude product. The remainder is used to maintain the recycled solvent inventory and to provide the hot liquid solvent feed for agitation during extraction, for depressurizing and at least in part for cracking/coking. As will be seen in FIG. 1, a portion of this medium cut is hydrotreated by well-known techniques which typically include catalytic treatment with hydrogen at about 650° F to 700° F under a pressure ranging between about 1000 psig and 3000 psig. Since the coal and at least part of the solvent are slurried under atmospheric pressure, it is necessary to depressurize the resulting hydrotreated liquid and to cool it so that it will be at the desired atmospheric pressure and temperature between about 100° F and 600° F just prior to slurrying. The hydrotreating of the medium cut may be described as a light to moderate hydrotreatment which typically adds from about 200 to 1000 standard cubic feet of hydrogen per barrel of liquid. This hydrotreatment is desirable inasuch as coal-derived solvents are not always recoverable unchanged from the coal solution and since the solvent power of the untreated recycled solvent may diminish steadily so that the recovered solvent can be said to differ in some way from the original solvent. This effect is probably attributable to the presence in the original extraction solvent of traces of reactive solvent species which are consumed in the first few cycles. However, if the solvent is hydrogenated prior to recycling, then there may be produced a recycle solvent, the solvent power of which is at least equal to that of the starting solvent.

The heavy, highest boiling product from the fractionator, comprising an extract distillate boiling in the 750+° F range, may be further fractionated, that having a boiling range of 750° F–900° F being hydrocracked to form a product material. Hydrocracking of this 750+ F –900° F cut plus the net production of the 400° F–750° F cut succeeds in adding from about 200 to 3000 standard cubic feet of hydrogen per barrel to these hydrocarbons and produces a $C_5$ to 750° F/800° F synthetic crude product which is a premium charging stock for a conventional oil refinery. The heavy bottom cut (boiling range in excess of 900° F) resulting from this further fractionation step requires too much hydrogen to economically convert it to suitable feed for further refining to white products. This 900+° F cut may be returned to the drum as a portion of the high-temperature solvent used for the cracking/coking step; or, it may be subjected to a separate coking step to produce ash-free coke for sale as high-purity coke for electrodes and such or for producing hydrogen for the process. It is also, of course, within the scope of this invention to divide the 750+° F fraction in any other suitable way and to handle portions of it for two or more of the purposes indicated.

Alternatively, the 750°+ F material need not be further fractionated, in which case it may be sold as a high-sulfur product or it may be used as liquid feed to a gasifier. There is, therefore, considerable flexibility in the choice of final products and the opportunity to balance the ratios of the various products.

All of the hydrogen required in the hydroconversion and hydrotreating of various product cuts may be furnished in the process (i.e., no hydrogen need be provided from external sources). In doing this, a portion of the high-ash coke residue from the drum resulting from the coking step after extraction may be used as a reducant; and in addition, any low-ash coke produced from the heavy bottom cut may also be used. In using the heavy bottom cut to produce hydrogen, this cut from the fractionation step is coked in a fluid coker to produce an ash-free coke and a light extract, the latter being added to the light extract stream resulting from fractionation and used as synthetic crude. It is also, of course, within the scope of this invention to form hydrogen by steam reforming using the top gas and light liquids ($C_2$–$C_4$) or by partial oxidation of the 750+° F and/or the 950+° F material.

The resulting ash-free coke from the fluid coker is an ideal material for hydrogen manufacture in the process of this invention. This coke is readily fluidizable, nonabrasive, attrition resistant, has no melting point and produces no slag. It can, therefore be used as a fuel or reductant at very high temperatures without encountering molten-slag handling and disposal problems. The production of hydrogen from this ash-free coke may be accomplished, for example, in the simplest type of commercial Lurgi generator. The product gases are then subjected to conventional shift conversion steps and acid gas removal. The resulting hydrogen is finally compressed to the required pressure for hydrotreating the medium cut and for hydrocracking the heavy cut.

The major heat requirement in the process of this invention is that for heating the solvent extractant. This heating of the solvent is preferably carried out in one or more direct-fired heaters which are typically fired by gaseous fuel. For example, this gaseous fuel, which is characterized as a low-Btu fuel gas, may be produced by gasifying the high-ash residue resulting from the decoking of the extraction drum in an air/steam-blown or oxygen/steam-blown gasifier, for example in such commerically available apparatus as a Wellman Galusha or Lurgi gasifier. Any fuel gas with caloric value from the hydrogen production step may be added to the low-Btu fuel gas thus formed. The heat for drying and preheating the coal particles may be furnished in whole or in part in the form of fuel gas from the solvent heater or in whole or in part by burning a portion of the low-Btu fuel gas generaged by gasifying the high-ash residue.

Using the conditions specified above and hydrotreated recycled solvent as the hydrogen-donor solvent extractant, the process of this invention can produce from about 3,500 to 5,500 tons of liquid hydrocarbon product from 10,000 tons of as-mined coal (equivalent to about 9,000 tons of moisture- and ash-free coal). The overall product balance for a 10,000 tons per day process can be summarized as follows:

| | | |
|---|---|---|
| coal as mined | 10,000 | Tons |
| coal--moisture- and ash-free | 9,000 | |
| liquid yield including heavy bottom cut | 4,200 | |
| gas and moisture yield | 800 | |
| high-ash coke byproduct | 2,000 | |

To the extent that the heavy bottom cut is coked, the total liquid yield will decrease since such coking gives rise to ash-free coke and a light cut which forms part of the liquid yield. If the ash-free coke is made in a separate coker it is available for hydrogen production.

Essentially all of the gases, high-ash coke and ash-free coke (if made) are consumed in the process for fuel and for hydrogen production.

Although the drum operation is of necessity a batch operation, the use of several drums (in which the steps through depressurization may be repeated several time before coking/cracking) operating in parallel makes it possible to operate the slurrying apparatus, heaters and fractionating tower continuously thus giving rise to what may be termed a semicontinuous process.

The product resulting from the process of this invention is free of fines and has a lower boiling range and a higher hydrogen to carbon ratio than products resulting from the prior art coal liquefaction processes and using the same amount of hydrogen. The product of this process is, moreover, more suitable for hydrocracking and desulfurization to form white products than that derived from prior art processes.

It will thus be seen that the objects set forth above, among those made apparent from the preceding description are efficiently attained and, since certain changes may be made in carrying out the above process without departing from the scope of the invention, it is intended that all matter contained in the above description shall be interpreted as illustrative and not in a limiting sense.

We claim:

1. A process for producing fluid hydrocarbon fuel from coal, comprising the steps of a. forming a slurry of finely divided, moisture-free coal and a hydrogen-donor solvent;
b. heating said slurry to an elevated temperature up to about 850° F;
c. charging the heated slurry into a drum wherein said coal is further contacted with said hydrogen-donor solvent to raise the temperature of the mass in the drum to between about 650° F. and 800° F;
d. maintaining the pressure within said drum at an elevated pressure no greater than about 150 psig while extracting hydrocarbons from said coal;
e. during said extracting, adding hydrocarbon vapor at an elevated temperature up to about 900° F thereby to agitate said mass within said drum and to further heat it;
f. depressurizing said drum to flash off the hydrocarbons while providing the latent heat of vaporization required for the volatilization of said hydrocarbons;
g. withdrawing fluid hydrocarbon products from said drum;
h. fractionating said fluid hydrocarbons withdrawn from said drum to form at least three cuts comprising a light cut hydrocarbon product, a medium cut hydrocarbon product having a boiling range of 450° F to 750° F and a heavy cut hydrocarbon product;
i. adding to said drum a hydrocarbon fraction at a temperature sufficient to heat the contents of said drum to about 850° F to 900° F in a quantity, for a time and at a pressure sufficient to crack at least a portion of the hydrocarbons extracted from said coal and remaining in said drum and to coke the residual solids in said drum thereby to produce additional fluid hydrocarbon products;
j. removing said additional fluid hydrocarbon products from said drum and adding them to said fluid hydrocarbons of step (g);
k. decoking said drum to remove the coked residue therefrom.

2. A process in accordance with claim 1 wherein said finely divided coal is sized no greater than 8-mesh.

3. A process in accordance with claim 1 wherein at least about 80% of said finely divided coal is sized minus 200-mesh.

4. A process in accordance with claim 1 wherein said finely divided coal is preheaated up to about 400° F prior to forming said slurry.

5. A process in accordance with claim 1 wherein said hydrogen-donor solvent comprises said medium cut hydrocarbon product subjected to hydrotreating.

6. A process in accordance with claim 1 wherein the weight ratio of hydrogen-donor solvent to coal in said slurry ranges between about 1 to 1 to about 4 to 1.

7. A process in accordance with claim 6 wherein said weight ratio of solvent to coal ranges between about 1.5 to 1 to about 3 to 1.

8. A process in accordance with claim 1 wherein said step of forming said slurry comprises providing said hydrogen-donor solvent at a temperature between about 100° F and 200° F.

9. A process in accordance with claim 1 wherein said step of forming said slurry comprises providing said hydrogen-donor solvent at a temperature between about 200° F and 600° F.

10. A process in accordance with claim 1 wherein said step of forming said slurry comprises providing one portion of said hydrogen-donor solvent at a temperature between about 100° F and 200° F and another portion at a temperature between about 200° F and 600° F.

11. A process in accordance with claim 1 wherein said step of forming said slurry is performed in an open system and the temperature of said slurry is maintained below the boiling point of said hydrogen-donor solvent.

12. A process in accordance with claim 1 wherein said step of forming said slurry is performed in a closed, pressurizable system and the temperature of said slurry is maintained below the peak viscosity point of said slurry.

13. A process in accordance with claim 1 wherein said heating of said slurry prior to charging it into said drum comprises raising its temperature to between about 700° F and about 850° F.

14. A process in accordance with claim 1 wherein the pressure maintained within said drum during said extracting ranges between about 50 psig and about 150 psig whereby a substantial portion of said solvent remains in a liquid state.

15. A process in accordance with claim 1 wherein the pressure maintained within said drum during said extracting ranges between about 20 psig and 80 psig whereby between about 10% and 70% of said solvent is flashed off for fractionating.

16. A process in accordance with claim 1 wherein said hydrocarbon vapor used for agitation during said extracting ranges in temperature between about 750° F and 900° F.

17. A process in accordance with claim 1 wherein said hydrocarbon vapor used for agitation during said extracting comprises said medium cut hydrocarbon product.

18. A process in accordance with claim 1 including the step of gradually reducing the pressure within said drum during said extracting to boil off a portion of said solvent and to further agitate said mass within said drum.

19. A process in accordance with claim 1 wherein the temperature of said mass within said drum during said extracting ranges between about 750° F and 800° F.

20. A process in accordance with claim 1 wherein said depressurizing step comprises reducing the pressure in said drum to between about 50 psig and 0 psig.

21. A process in accordance with claim 1 wherein said step of providing said latent heat of vaporization during depressurizing comprises introducing solvent vapors at a temperature between about 750° F and 950° F into said drum.

22. A process in accordance with claim 21 wherein said solvent vapors used to provide said latent heat of vaporization comprise said medium cut hydrocarbon product at a temperature between about 750° F and 950° F.

23. A process in accordance with claim 1 wherein said hydrocarbon fraction added in step (i) to accomplish cracking and coking comprises at least in part said medium cut hydrocarbon product at a temperature between about 850° F and 900° F.

24. A process in accordance with claim 1 including the step of further fractionating said heavy cut hydrocarbon product to form a heavy side cut having a boiling range of about 750° F to 900° F and a heavy bottom cut having a boiling range in excess of 900° F.

25. A process in accordance with claim 24 including the step of heating at least a portion of said heavy bottom cut to between about 850° F and about 900° and adding it to said drum in step (i) as a portion of said hydrocarbon fraction.

26. A process in accordance with claim 24 including the step of coking at least a portion of said heavy bottom cut to form ash-free coke and a light hydrocarbon product.

27. A process in accordance with claim 26 including the step of using said ash-free coke and said coked residue from step (k) to form hydrogen.

28. A process in accordance with claim 1 including the step of steam reforming top gas from said drum and at least a portion of said light cut to form hydrogen for hydrotreating and hydrocracking.

29. A process in accordance with claim 1 including the step of partially oxidizing at least a portion of said heavy cut to form hydrogen for hydrotreating and hydrocracking.

30. A process in accordance with claim 1 wherein said step (j) of removing said additional fluid hydrocarbon products comprises steam stripping.

31. A process in accordance with claim 1 wherein steps (a) through (h) are repeated at least once prior to performing steps (i) through (k).

32. A process in accordance with claim 1 wherein at least two drums operating alternately in parallel are used.

33. A process in accordance with claim 1 including the step of preheating said drum prior to said charging it with said slurry.

34. A process in accordance with claim 1 including the step of pressurizing said drum with an inert gas prior to charging it with said slurry.

* * * * *